United States Patent [19]

Kwiatek

[11] Patent Number: 4,810,188

[45] Date of Patent: Mar. 7, 1989

[54] SPARK IGNITED GAS BURNER ASSEMBLY

[75] Inventor: David J. Kwiatek, Berwyn, Ill.

[73] Assignee: Harper-Wyman Company, Lisle, Ill.

[21] Appl. No.: 166,042

[22] Filed: Mar. 9, 1988

[51] Int. Cl.[4] ..... F23Q 3/00

[52] U.S. Cl. ..... 431/266

[58] Field of Search ..... 431/264, 266

[56] References Cited

U.S. PATENT DOCUMENTS

| | | |
|---|---|---|
| 546,923 | 9/1895 | Groebbels . |
| 818,131 | 4/1906 | Taylor . |
| 2,022,033 | 11/1935 | Furlong . |
| 2,705,531 | 4/1955 | Rice et al. . |
| 3,386,432 | 6/1968 | Hanson . |
| 3,551,083 | 12/1970 | Michaels . |
| 3,584,987 | 6/1971 | Michaels . |
| 3,592,179 | 7/1971 | Hahn . |
| 3,628,903 | 12/1971 | Hoyt . |
| 3,758,264 | 9/1973 | Fijalkowski . |
| 3,799,730 | 3/1974 | Das et al. . |
| 3,938,944 | 2/1976 | Riehl . |
| 4,002,419 | 1/1977 | Hantack et al. . |
| 4,518,346 | 5/1985 | Pistien . |
| 4,626,196 | 12/1986 | Stohrer, Jr. . |

FOREIGN PATENT DOCUMENTS

| | | |
|---|---|---|
| 7735408 | 6/1978 | France . |
| 7732910 | 6/1979 | France . |
| 7801096 | 8/1979 | France . |
| 7808145 | 8/1978 | Netherlands . |
| 1175225 | 12/1969 | United Kingdom . |
| 1450153 | 9/1976 | United Kingdom . |
| 1543618 | 4/1979 | United Kingdom . |
| 1544624 | 4/1979 | United Kingdom . |
| 2085576A | 4/1982 | United Kingdom . |

*Primary Examiner*—Carroll B. Dority, Jr.
*Attorney, Agent, or Firm*—Mason, Kolehmainen, Rathburn & Wyss

[57] ABSTRACT

A gas burner assembly includes an electrically conductive burner cap body with a plurality of burner ports and an ignition port formed in a sidewall of the burner cap body. The burner cap body is connected to an electrical ground potential. An electrically insulative support member is mounted in the ignition port and defines an electrode receiving aperture. The support member cooperates with the ignition port to define an ignition gas pathway. A spark electrode is positioned within the burner chamber and projects through the support member aperture spaced apart from the ignition gas pathway. The spark electrode is selectively connected to a high voltage potential for providing ignition sparks between the electrode and the burner body through the ignition gas pathway.

20 Claims, 2 Drawing Sheets

SPARK IGNITED GAS BURNER ASSEMBLY

BACKGROUND OF THE INVENTION

The present invention relates to gas burners and more particularly to an improved gas burner assembly for spark ignition.

Spark ignition is increasingly used because it avoids the energy consumption and heat caused by a standing igniter pilot flame that was often used in past to ignite gas burners such as gas range top burners.

U.S. Pat. No. 4,518,346 discloses a gas burner with a pair of electrodes for spark ignition inside the burner with a protective cap mounted on the burner body and orifices and grooves provided in an upper burner head part providing secondary air to permit ignition inside the burner. Disadvantages of this type of arrangement are the complexity of the assembly and unrelialibity in achieving ignition that may result from either low gas flow conditions or contamination within the secondary air grooves or orifices.

France Pat. No. 77 32910 discloses an electronic ignition gas burner with an electrode positioned directly within the primary air-gas fuel flow through a main burner port. With this type of ignition, reliable and repeatable operations may not be achieved due to the electrode position.

U.S. Pat. No. 4,626,196 discloses a spark ignited gas burner assembly including a burner body with an array of main burner ports, an electrically conductive burner top member and a spacer assembly to separate and electrically insulate the burner body and top member. An ignition gas pathway is defined between the burner body and the top member. A spark ignition circuit includes a spark gap in series circuit relationship between the burner body and the top member to provide ignition sparks in the ignition gas pathway. While this arrangement provides advantages over various known spark ignited burner assemblies, it is desirable to provide a burner assembly that enables repeatable and reliable ignition operations without using a separate top member electrically isolated from the burner body, that reduces the likelihood of electrical shock to the user, that is simple and inexpensive to make and to assemble, that includes a burner cap assembly which can be readily removed for cleaning, and that facilitates a more easily cleaned range configuration.

SUMMARY OF THE INVENTION

Among the important objects of the invention are to provide an improved gas burner assembly for spark ignition; to provide a burner assembly making possible a simplified, less expensive and easily cleaned configuration; and to provide a burner assembly that overcomes many of the disadvantages of prior art burner assemblies.

In brief, in accordance with the above and other objects of the present invention, there is provided a gas burner assembly including an electrically conductive burner cap body with a plurality of burner ports and an ignition port formed in a sidewall of the burner cap body. The burner cap body is connected to an electrical ground potential. An electrically insulative support member is mounted in the ignition port and defines an electrode receiving aperture. The support member cooperates with the ignition port to define an ignition gas pathway. A spark electrode is positioned within the burner chamber and projects through the support member aperture spaced apart from the ignition gas pathway. The spark electrode is selectively connected to an high voltage potential for providing ignition sparks between the electrode and the burner body through the ignition gas pathway.

BRIEF DESCRIPTION OF THE DRAWING

The present invention and its objects and advantages may be better understood from consideration of the following detailed description of the preferred embodiments of the invention illustrated in the accompanying drawings in which:

FIG. 6 is a perspective view of the burner cap assembly removed from a stationary base assembly of the burner assembly of FIG. 1;

DETAILED DESCRIPTION OF THE PREFERRED EMBODIMENTS

Figure 1:
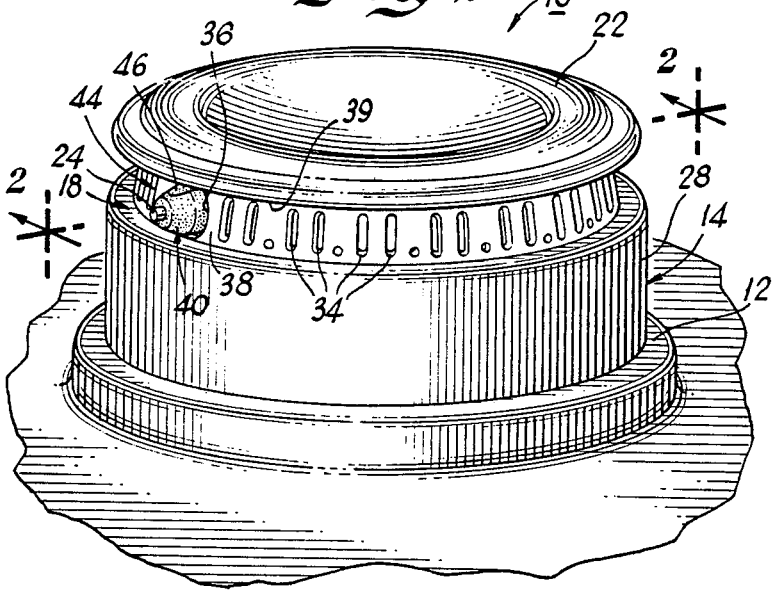
FIG. 1 is a perspective view of a portion of a range top including a burner assembly constructed in accordance with the invention.
Figure 2:
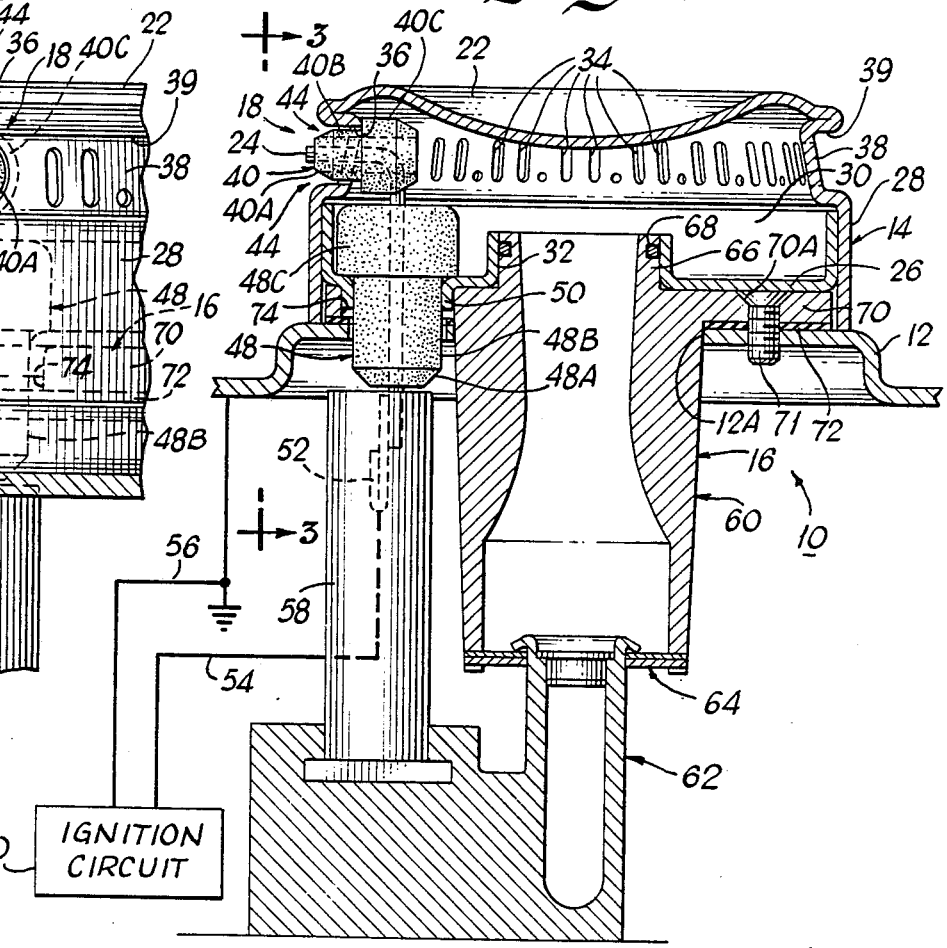
FIG. 2 is a partly schematic illustration of the burner assembly with a sectional view taken along the line 2—2 of FIG. 1.

Referring to FIGS. 1, 2, and 6, there is shown a gas burner assembly constructed in accordance with the principles of the present invention and designated as a whole by the reference numeral 10. A portion of a range top or cooking top 12 is shown with the burner assembly 10. The burner assembly 10 includes a detachable burner cap assembly designated as 14 and a stationary base assembly deisgnated as 16. A spark electrode assembly designated as 18 is included with the burner cap assembly 14 for spark ignition.

An ignition circuit 20 provides an electrical ground potential to a burner cap 22 and selectively provides a high voltage potential to a spark electrode 24 of the cap assembly 14 causing ignition sparks to be produced. The ignition circuit 20 is under the control of a valve switch associated with a burner valve (not shown) that controls the fuel rates to the burner assembly 10 from an off condition to a wide range of gas flow rates. The electrode 24 functions as a flame sensing probe during normal burner operation of the burner assembly 10. The ignition circuit 20 may be generally of the character disclosed in the before mention U.S. Pat. No. 4,626,196, hereby incorporated by reference. It should be understood that other types of ignition circuits may be used to provide spark ignition at the burner assembly 10.

As its component parts, the burner cap assembly 14 includes the burner cap 22, a bottom plate 26 and the spark electrode assembly 18. The burner cap 22 and the bottom plate 26 are formed of electrically conductive material, such as stamped sheet metal of a #3003 aluminum alloy. The burner cap 22 and the bottom plate 26 are electrically connected with the range top 12 to electrical ground so that a separate ground connection and an insulative spacer member are not required.

In general, the detachable burner cap assembly 14 can be removed from the stationary base assembly 16, for example, for cleaning in an automatic dishwasher or in a self-cleaning oven. As described below, the burner cap assembly 14 is arranged as a modular unit to prevent disassembly of its component parts by the user so that problems resulting from possible misassembly or parts being displaced are avoided.

As shown in FIG. 2, the detachable burner cap assembly 14 includes the bottom plate 26 press fit or otherwise securely attached within a lower portion 28 of the a generally cylindrical burner cap body 22 defining a burner fuel chamber 30. The bottom plate 26 includes a gas inlet 32 (FIG. 6) for supplying primary air-gas fuel mixture to the burner fuel chamber 30 from the stationary base assembly 16. Fuel flows from the chamber 30 through a plurality of main burner ports 34 and an ignition port 36 formed in a recessed portion 38 below a top wall 39 of the burner body 22. Secondary air for combustion at the ignition port 36 and the burner ports 34 flows from above the range top 12 rather than from an internal burner box location.

An electrically insulative support member designated as 40 of the spark electrode assembly 18 positions the spark electrode 24 for reliable and repeatable ignition throughout the entire range of gas flow rates for the burner assembly 10.

Figure 5:
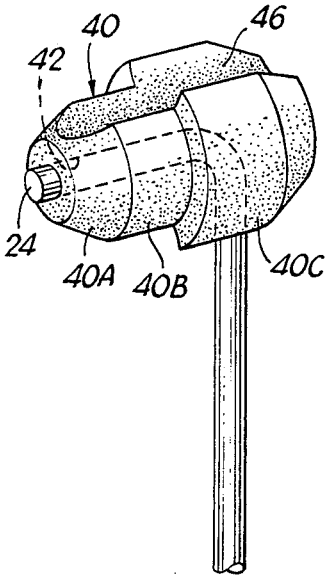
FIG. 5 is a perspective view illustrating a spark electrode assembly of the burner assembly of FIG. 1.
Figure 5:
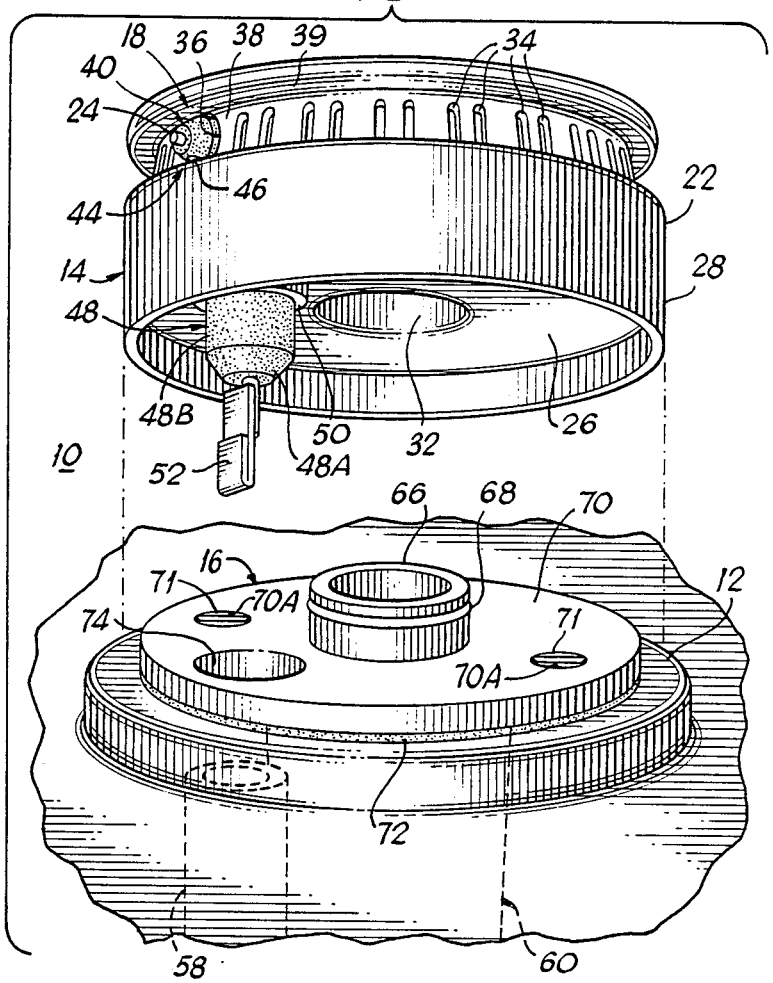

As best seen in FIG. 5, the insulative support member 10 has a centering tapered nose portion 40A, an intermediate body portion 40B slideably received within the ignition port 36 (FIGS. 1 and 2) and a rear body portion 40C positioning the nose portion 40A by providing a stop against the inside burner wall portion 38. The insulative support member 40 has a generally centrally disposed aperture 42 extending from the nose portion 40A to the rear body portion 40C for receiving the spark ignition electrode 24. The spark ignition electrode 24 is offset or L-shaped extending from the chamber 30 through the support member aperture 42 outside the burner body 22 and downwardly to the base assembly 16. Aperture 42 is similarly L-shaped to accommodate the spark ignition electrode 24.

Figure 3:
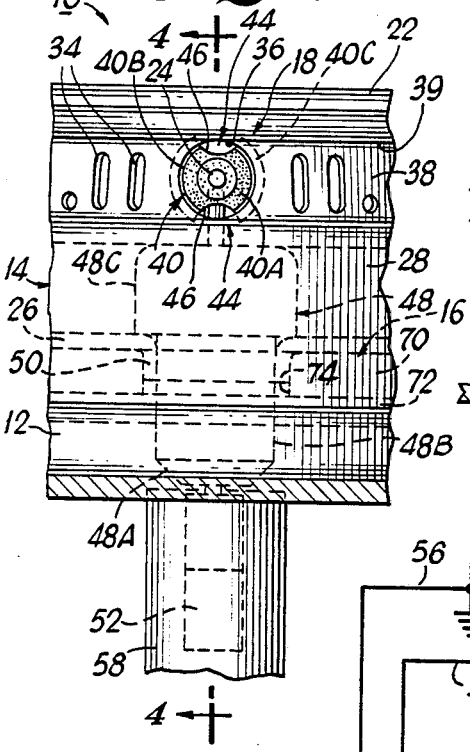
FIG. 3 is a fragmentary sectional view taken along the line 3—3 of FIG. 2.

An ignition gas region 44 is defined by the support member 40 in cooperation with the ignition port 36. Ignition port 36 is circular and has a diameter generally coinciding with the intermediate body portion 40B of the support member 40. As shown in FIGS. 3 and 5, a pair of generally U-shaped undercut grooves 46 are formed longitudinally along the outer periphery of the support member 40. When fuel is supplied to the burner assembly 10, ignition gas flows from chamber 30 through the grooves 46 to the ignition region 44 spaced between the spark electrode 24 and the burner top wall 39 and the burner body 28.

Figure 4:
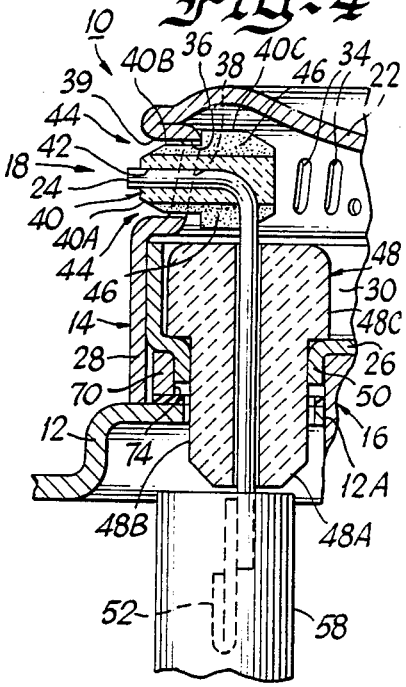
FIG. 4 is a fragmentary sectional view taken along the line 4—4 of FIG. 3.

As shown in FIGS. 2, 4, and 6, a second electrically insulative support member 48 of the spark electrode assembly 18 receives and isolates the electrode 24 from the burner body 22 and the bottom plate 26. The insulative support member 48 has a centering tapered nose portion 48A, an intermediate body portion 48B and an upper body portion 48C. The intermediate body portion 48B of the insulative support member 48 is press fit or otherwise securely attached within a generally circular sleeve 50 of the base plate 26 with the upper body portion 40C providing a stop against the base plate 26.

Insulative support members 40 and 48 are formed of an electrically insulating material, such as alumina or a composition ceramic material with a hard finish for cleanability. Spark ignition electrode 24 is an integral member formed of electrically conductive material, such as #310 stainless steel, having sufficient strength and stiffness needed to facilitate assembly of the burner cap 22 with the spark electrode assembly 18.

Assembly of the burner cap assembly 14 is simply provided by placing the first support member 40 with the spark electrode 24 positioned within its aperture 42 in the ignition port 36 and then attaching the base plate 26 with the second support member 48 secured within its sleeve 50 aligned for receiving the spark electrode 24. Then a terminal blade 52 is attached to the spark electrode 24 that in assembled relation extends within the stationary base assembly 16.

Electrical connection to the spark electrode 24 and the burner body 22 is made in any conventional fashion. In FIG. 2, a pair of conductors 54 and 56 are schematically shown from the ignition circuit 20 to provide the high voltage connection to the spark electrode 24 via the terminal blade 52 and the ground connection to the burner cap 22 through the range top 12.

As its major components, the stationary base assembly 16 includes a high voltage receptacle 58 and a venturi designated as 60. Venturi 60 is positioned around a gas inlet fitting 62 that is connected to an air shutter assembly 64 for supplying the mixture of gas and primary air to the burner cap assembly 14 through the venturi 60. Frictional interengagement of the burner cap assembly 14 is provided with the base assembly 16. Venturi 60 supplies primary air-gas mixture to the detachable burner cap assembly 14 through a centering projection 66 carrying a snap ring 68 clinched by the inlet 32 of the base plate 26 in assembled relation. As seen in FIG. 6, an upstanding flange or wall portion 70 includes a pair of apertures 70A. The flanged portion 70 is secured to the range top 12 by a pair of fasteners 71 received through the apertures 70A with one shown in FIG. 2. The fasteners 71 provide an effective electrical ground connection between the range top 12 and the venturi 60 and through the bottom plate 26 to the burner cap body 22. A gasket 72 is sandwiched between the flanged portion 70 and range top 12 to provide an effective liquid seal. In general outline, the flanged portion 70 is annular and has an outside diameter slightly smaller than the inside diameter of the burner cap 22. The insulative support member 48 is received through an opening 74 separated from the venturi gas supply 66 in the flanged portion 70.

As shown in FIG. 1, the burner assembly 10 makes possible a simple and easily cleaned range top or cooking top configuration. The stationary base assembly 16 is received in an opening 12A of the range top 12 bounded by the flanged portion 70 around which the burner cap 22 rests. The range top 12 is otherwise imperforate and includes no openings or spaces around the burner assembly 10 where contamination such as spillover from a cooking vessel can enter the region below the range top 12.

Figure 7:
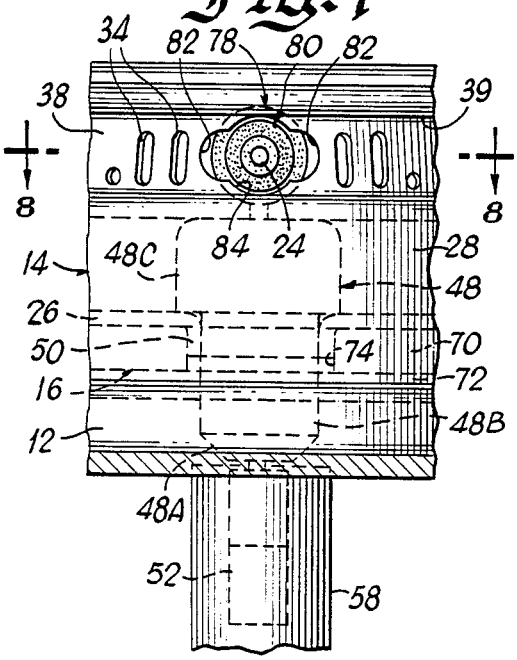
FIG. 7 is a fragmentary sectional view similar to FIG. 3 illustrating an alternative spark electrode assembly.
Figure 8:
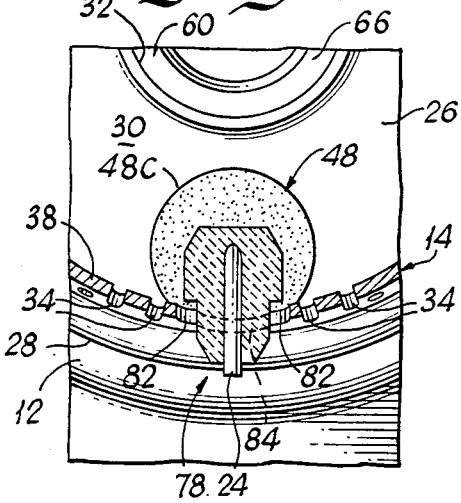
FIG. 8 is a fragmentary sectional view taken along the line 8—8 of FIG. 7.

Referring now to FIGS. 7 and 8, an alternative arrangement of a spark electrode assembly 78 is shown. In the alternative assembly 78, an insulative support member 80 is formed without channels such as the undercut grooves 46 in the insulative support member 40. Instead a pair of scallops 82 is configured in the periphery of the ignition port 84 to define the ignition gas pathway.

While the scallops 82 are shown extending generally horizontally, vertically arranged cutouts may be preferable to define the ignition gas pathway between the electrode 24 and the walls 39 and 28 of the burner cap body 22. It should be understood that various other configured ignition ports and/or insulative support members could be employed to define the ignition gas pathway.

Although the present invention has been described in connection with details of the preferred embodiments, many alterations and modifications may be made without departing from the invention. Accordingly, it is intended that all such alterations and modifications be considered as within the spirit and scope of the invention as defined in the appended claims.

What is claimed and desired to be secured by Letters Patent is:

1. A gas burner assembly comprising:

an electrically conductive burner cap body including a sidewall;

a plurality of burner ports and an ignition port formed in said burner body sidewall;

an electrically insulative support member mounted in said ignition port having an electrode receiving aperture, said support member and said ignition port cooperating to define an ignition gas pathway; and a spark electrode extending through said support member aperture and including a portion extending through said ignition port and completely surrounded by said insulating support member.

2. A gas burner assembly as recited in claim 1 wherein said burner cap body being connected to an electrical ground potential and said spark electrode being selectively connected to an high voltage potential for providing ignition sparks between said electrode and said burner body through said ignition gas pathway.

3. A gas burner assembly as recited in claim 1 wherein said electrically insulative support member includes a plurality of longitudinal grooves formed along a periphery of said electrically insulative support member defining said ignition gas pathway.

4. A gas burner assembly as recited in claim 1 wherein said ignition port includes a plurality of channels formed along said ignition port defining said ignition gas pathway.

5. A gas burner assembly as recited in claim 1 wherein said plurality of burner ports and an ignition port are formed in a recessed portion of said burner cap body sidewall proximate to an upper wall of said burner cap body.

6. A gas burner assembly as recited in claim 1 wherein said burner cap body is a generally circular cylindrical sheet metal part, said plurality of burner ports are uniformly spaced apart around said sidewall and said ignition port is generally centrally disposed between a pair of said burner ports.

7. A gas burner assembly as recited in claim 1 further comprising a bottom plate secured to said burner cap body having a gas inlet for receiving primary air-gas fuel mixture.

8. A gas burner assembly as recited in claim 7 further comprising a second electrically insulative support member for receiving said spark electrode and wherein said bottom plate includes an aperture separated from said gas inlet for receiving said second electrically insulative support member.

9. A gas burner assembly as recited in claim 8 wherein said spark electrode extends through said second electrically insulative support member for connection with said high voltage potential of an ignition circuit.

10. A gas burner assembly as recited in claim 1 further comprising a base assembly supported by a range top having a generally circular outer base edge and wherein said burner cap body has a generally circular outer cap edge overlying said outer base edge.

11. A gas burner assembly as recited in claim 10 wherein said burner cap body includes an inlet for receiving a primary air-gas mixture and said base assembly includes an outlet for supplying the primary air-gas mixture to said burner cap inlet.

12. A gas burner assembly as recited in claim 11 wherein said burner cap inlet is defined by a bottom plate secured to said burner cap body having a central opening for receiving the primary air-gas mixture and said base assembly outlet is defined by an upstanding tubular portion received in said base plate opening and spring means for securing said tubular portion within said base plate opening.

13. A gas burner assembly as recited in claim 12 wherein said bottom plate and said base assembly include aligned openings for receiving a second electrically insulative support member, said spark electrode extending through said second electrically insulative support member.

14. A gas burner assembly comprising:

an electrically conductive burner cap body including a sidewall;

a plurality of burner ports and an ignition port formed in said burner body sidewall;

a bottom member secured to said burner cap body to define a fuel chamber, said bottom member having an inlet for receiving the primary air-gas mixture;

a spark electrode positioned within said chamber and extending through said ignition port; and insulative support means for electrically isolating said spark electrode from said burner cap body and for defining an ignition gas pathway between said insulative support means and said burner cap body, the portion of said spark electrode extending through said ignition port being completely surrounded by said insulative support means over most of its length, said burner cap body being connected to an electrical ground potential and said spark electrode being selectively connected to a high voltage potential for providing ignition sparks between said electrode and said burner body through said ignition gas pathway.

15. A gas burner assembly for use with a gas range comprising:

a base assembly secured to the gas range including an outlet for supplying a primary air-gas mixture and an electrical receptacle for providing a high voltage potential connection;

a detachable burner cap assembly including an electrically conductive burner cap body connected to an electrical ground potential, said burner cap body being configured with a plurality of burner ports and an ignition port in a burner cap body sidewall; a bottom member secured to said burner cap body to define a fuel chamber, said bottom member being configured with an inlet adapted for removable connection to said base assembly outlet for receiving the primary air-gas mixture and a spaced apart passageway for enabling connection with said high voltage potential; an electrically insulative support member extending through said ignition port, said support member and said ignition port cooperating to define an ignition gas pathway; and a spark electrode connected to said electrical receptacle extending through said bottom member passageway to said chamber and projecting through said insulative support member spaced apart from said ignition gas pathway, the portion of said electrode extending through said ignition port being completely surrounded by said insulative support member along most of its length, said spark electrode being selectively connected to an high voltage potential for providing ignition sparks between said electrode and said burner body through said ignition gas pathway.

16. A gas burner assembly as recited in claim 15 wherein said electrically insulative support member includes a plurality of longitudinal grooves formed along a periphery of said electrically insulative support member defining said ignition gas pathway.

17. A gas burner assembly as recited in claim 15 wherein said base assembly has an upper portion with a generally circular outer base edge and wherein said burner cap body has a generally circular outer cap edge overlying said outer base edge.

18. A gas burner assembly as recited in claim 15 wherein said base assembly outlet is defined by an upstanding tubular portion received in said bottom member inlet and includes spring means for removably securing said tubular portion within said bottom member inlet.

19. A gas burner assembly as recited in claim 15 further comprising a second electrically insulative support member mounted within said bottom member passageway for receiving and isolating said spark electrode from said bottom member and said burner cap body.

20. A gas burner assembly as recited in claim 15 wherein said base assembly includes an air shutter assembly and a venturi operatively associated with said air shutter assembly.

* * * * *